US006358104B2

(12) United States Patent
Daugherty et al.

(10) Patent No.: US 6,358,104 B2
(45) **Date of Patent: *Mar. 19, 2002**

(54) HIGH CURRENT TERMINAL

(75) Inventors: James D. Daugherty, Brookfield; William G. Strang; Robert Stang, both of Warren; Christopher Adrian Margrave, Cortland, all of OH (US)

(73) Assignee: Delphi Technologies, Inc., Troy, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/480,069

(22) Filed: Jan. 10, 2000

(51) Int. Cl.[7] ..... H01R 13/11
(52) U.S. Cl. ..... 439/851
(58) Field of Search ..... 439/851, 852, 439/843, 846

(56) References Cited

U.S. PATENT DOCUMENTS 4,750,897 A * 6/1988 Neidecker ..... 439/825
5,033,982 A * 7/1991 Lucas ..... 439/750
5,326,288 A * 7/1994 Lu et al. ..... 439/851
5,658,175 A * 8/1997 Muzslay ..... 439/852
5,667,413 A * 9/1997 Trafton ..... 439/843
5,720,634 A * 2/1998 Sten ..... 439/843
5,775,960 A * 7/1998 Saito et al. ..... 439/843
5,820,423 A * 10/1998 Hsu ..... 439/851
5,921,822 A * 7/1999 Kennedy et al. ..... 439/851
5,951,338 A * 9/1999 Seko et al. ..... 439/843
6,010,377 A * 1/2000 Dechelette et al. ..... 439/851
6,042,432 A * 3/2000 Hashizawa et al. ..... 439/843
6,254,439 B1 * 7/2001 Endo et al. ..... 439/843

* cited by examiner

*Primary Examiner*—Brian Sircus
*Assistant Examiner*—Thanh-Tam Le
(74) *Attorney, Agent, or Firm*—Thomas A. Twomey

(57) ABSTRACT

Disclosed herein is an electrical female terminal which comprises a direct current path between a contact region defined by a plurality of circumferentially spaced contact vanes formed as beams having opposite ends connected to terminal body portions and wherein each vane is twisted on its length to provide a radially inwardly directed contact on a beam that provides a torsional force component that increases normal forces for providing electrical contact without producing a commensurate increase in the force required to engage a pin within the contact region.

11 Claims, 2 Drawing Sheets

HIGH CURRENT TERMINAL

TECHNICAL FIELD

The present invention relates to electrical female terminals of the plug through type and more specifically, to electrical female terminals configured to connect to electric cables and to receive male plugs of the plug through type.

BACKGROUND OF THE INVENTION

One-piece electrical female terminals for connecting to electric cables and to male plugs are known in the art. One example of a two way electrical female terminal is found in U.S. Pat No. 5,720,634. Such arrangements eliminate the need for separate terminal parts and are configured for automatic inspection by insertion of a light source through one end of the finished one-piece fabrication. A typical so called plug through electrical female terminal includes cable and wire clips or wings at one end of the terminal. The terminal includes a neck segment that connects the clips to an integral barrel or can segment that is connected by a strap to a terminal pin support portion having contact fingers thereon. These contact fingers are housed within the integral can and are configured to engage the sides of a male pin inserted there through.

During fabrication such electrical female terminals are stamped from a sheet of material to form a cable connection end with the clips or wings thereon. The clips or wings are connected by a transition region to a connector strap and thence to a region having contact fingers thereon. Once the part is stamped, the connector strap is bent to locate the contact fingers within the transition region that in turn is formed as an open-ended split barrel or cap enclosing the contact fingers. The contact fingers define a cavity into which a male pin can be passed through and the contact fingers are configured to provide a positive electrical connection between the contact fingers and the plug. Electrical female terminals of the prior art embodying such cable connection and plug through features require the contact fingers to be formed on beams that limit the degree of spring contact force.

While electrical female terminals of the prior art are suitable for many applications, it is desirous to be able to stamp such terminals from thick stock to improve their current capacity and to provide a vane configured spring contact geometry that assure a high normal force around the full circumference of a mating pin to provide such current conduction between the electrical female terminal and a through plug connection thereto.

SUMMARY OF THE INVENTION

It is an object of the present invention to provide an electrical female terminal comprising a direct current path between a contact region defined by a plurality of circumferentially spaced contact vanes formed as beams having opposite ends connected to terminal body portions and wherein each vane is twisted on its length to provide a radially inwardly directed contact on a beam that provides a torsional force component that increases normal forces for providing electrical contact without producing a commensurate increase in the force required to engage a pin within the contact region.

A feature of the present invention is that the amount of torsional force in each of the contact vanes can be determined by the amount of offset formed between the center of each vane, the length of each vane and the width of the base of each of the vanes.

Another feature of the present invention is that each of the contact vanes is enclosed within an integral can to provide protection of the contact vanes when shaped to form radially inwardly directed contact regions thereon.

Another feature of the present invention is to provide a plurality of circumferentially spaced contact vanes, each formed with a radially inwardly directed contact portion thereon and a can that will fully support each of the contact vanes between the opposite ends thereof during mating of a contact pin therein the inner contact region is fully supported circumferentially wherein each of the contact vanes is supported between their opposite ends and throughout their length by an integral can.

Another feature of the present invention is to configure each of the contact vanes as beams that when contact with an inserted pin will be subjected to torsional and bending stresses that will cause each of the vanes to twist and straighten so as to come into contact with the integral can at a significant normal force there between thereby to provide a current path from the pin through the can and its connecting strap as well as through contact with the inner contact body.

A further feature is to provide such an arrangement wherein the can provides bending overstress protection and promotes torsional deflection of the contact vanes.

Another feature of the present invention is to configure the contact vanes from high mass material for dissipating heat generated within high current flow connector systems.

Other objects and features of the present invention will become apparent to those skilled in the art in light of the following detailed description of a preferred embodiment of the present invention, setting forth the best mode of the invention contemplated by the inventors and illustrated by the accompanying sheets of drawings.

DESCRIPTION OF THE PREFERRED EMBODIMENT

Figure 1:
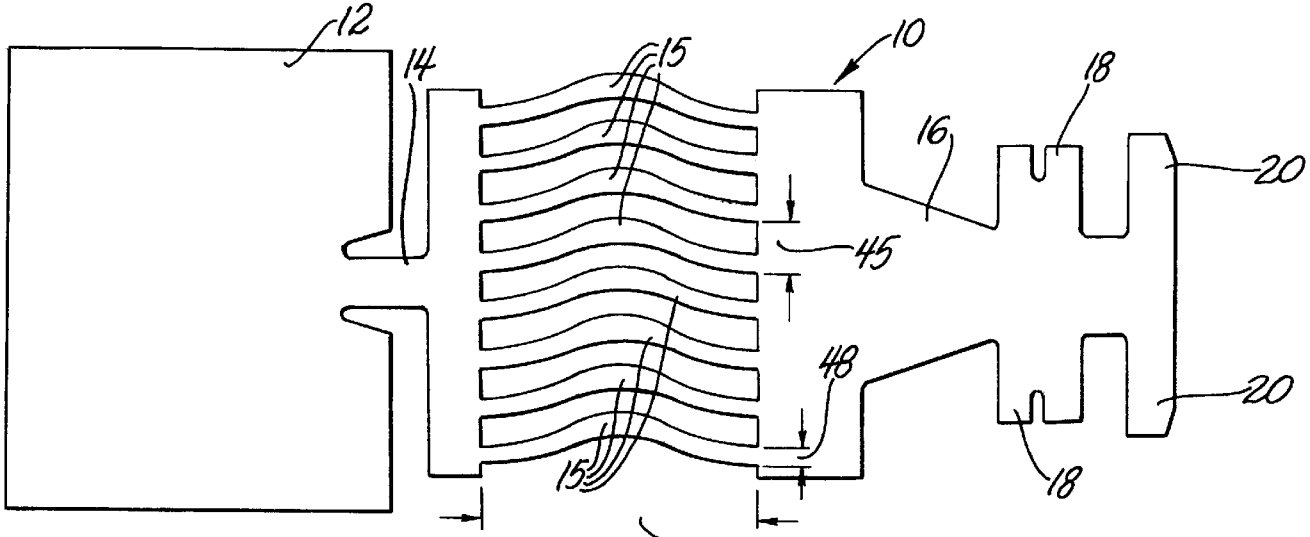
FIG. 1 is a top plan view of a blank utilized in preparing a female terminal of the present invention.

Referring now to FIG. 1, the female electrical terminal of the present invention comprises a preform 10 that is stamped from the strip stock by a process set-forth more particularly in U.S. Pat No. 5,720,634 that is incorporated herein by reference. The process advances the strip stock through a series of stamping stations so as to produce a preform 10 having a can forming portion 12, a connecting strip 14, a plurality of wave shaped beam type contact strips 15. The contact strips 15 are connected by a transition segment 16 to wire preform wings 18 and cable preform wings 20.

Figure 3:
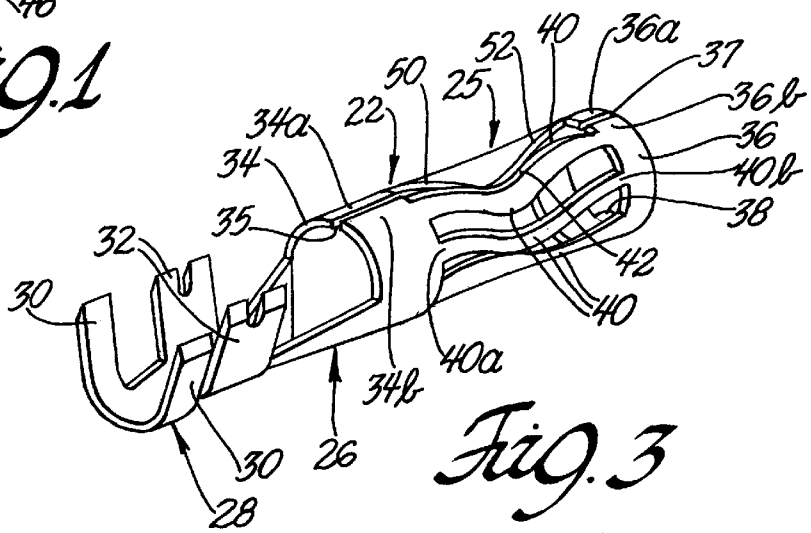
FIG. 3 is an isometric view of an electrical female terminal of the present invention with an integral protective can removed.

As discussed in detail in the '634 patent the preform is than shaped by known steps to form a single piece electrical female terminal 22 of the present invention as shown in FIGS. 2–5. FIG. 3 shows the electrical female terminal 22 with an integral outer protective can portion 23 removed to better show a contact portion 25 that is joined by a bent tapered transition portion 26 to an attachment portion 28.

The attachment portion 28 includes upwardly bent spaced cable contact tabs 30 that are shaped from the preform wings 20. The attachment portion 28 also includes upwardly bent spaced wire contact tabs 32 that are shaped from the preform wings 18. The transition portion 26 is integrally formed with an annular strip 34 that forms a terminus at one end of the contact portion 25. The annular strip 34 includes two end portions 34*a,* 34*b* that have a gap 35 formed there between. The opposite end of the contact portion 25 includes an annular strip 36 that forms a terminus at the opposite end of the contact portion 25.

Figure 2:
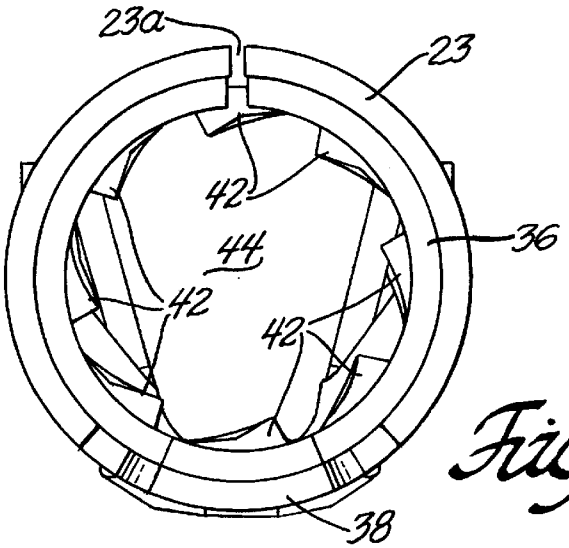
FIG. 2 is an end elevational view of the present invention.
Figure 4:
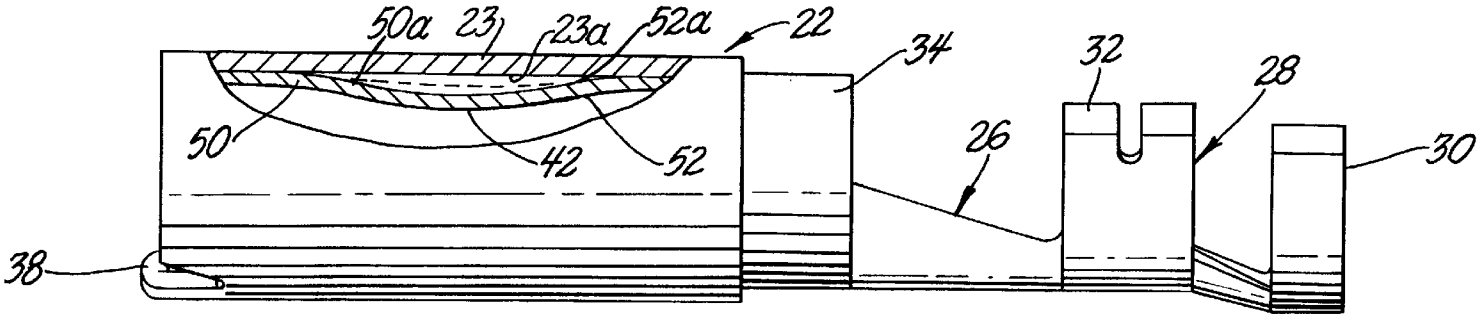
FIG. 4 is an enlarged side elevational view of the present invention.
Figure 5:
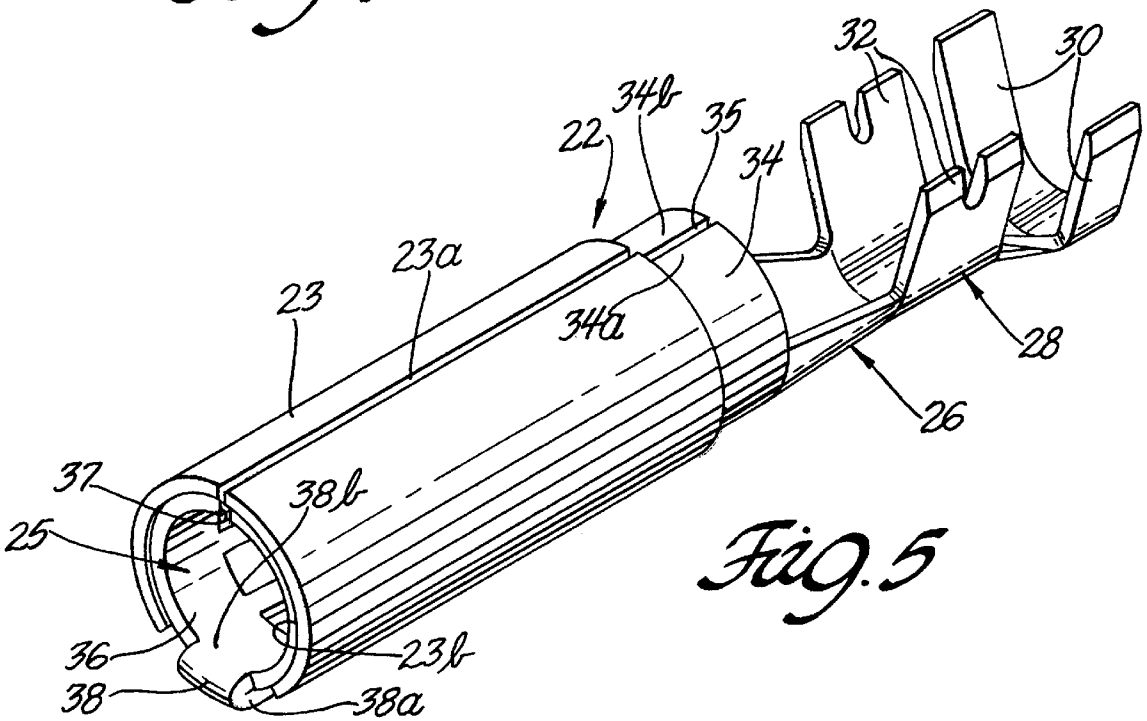
FIG. 5 is an isometric view of an electrical female terminal of the present invention with an integral protective can.

The annular strip 36 includes end portions 36*a,* 36*b* forming a gap 37 there between. A reversibly bent connecting strap 38 is shaped from the connecting strip 14. The connecting strap 38 is integrally connected at one end 38*a* to the protective can 23. As shown in FIG. 5, the opposite end 38*b* of strap 38 is connected to the annular strip 36 and attached to the respective strips 34, 36 at longitudinally aligned location as best shown in FIGS. 2 and 3. The protective can portion 23 includes a split line 23*a* along its length.

A plurality of circumferentially spaced, contact vanes 40 are formed between the strips 34, 36 and attached to the respective strips 34, 36 at longitudinally aligned location as best shown in FIGS. 2 and 3. Each of the contact vanes 40 are twisted from the wave shaped strips 15 of the preform 10. The twisted contact vanes 40 are configured so as to have radially inwardly directed contact edges 42 that are adapted to engage a pin directed into an open ended socket 44 formed interiorly of the contact portion 25, as best shown in FIG. 2. The socket 44 is configured for ease of inspection by methods set forth in the '634 patent wherein an inspection light can be directed end to end of the finished female terminal 22 for detecting any flaws in its manufacture.

The electrical female terminal 22 has a direct current path between the contact portion 25 defined by a plurality of circumferentially spaced contact vanes 40. Each of the vanes 40 constitute beams 40 formed between the strips 34, 36. The vanes 40 each have opposite ends 40*a,* 40*b* connected to terminal body portions defined by the strips 34, 36. As stated above and as shown in FIG. 3, opposite ends 40*a,* 40*b* of each vane 40 are longitudinally aligned. Each vane 40 is twisted between its opposite ends 40*a,* 40*b* long its length to provide the radially inwardly directed contact point or edge 42 extending radially inward to the portion 25 beam 40. By virtue of the illustrated configuration each beam 40 provides a torsional force component that increases normal forces for providing electrical contact without producing a commensurate increase in the force required to engage the pin within the contact portion 25 at a socket 44 therein.

The amount of torsional force in each of the contact vanes 40 is determined by the amount of offset between the center of each vane as shown at 45 in FIG. 1, the length of each vane shown at 46 in FIG. 1 and the width of the base of each of the vanes shown at 48 in FIG. 1. The torsional force component provided by each of the vanes increases normal forces between the vanes and a pin inserted in the socket 44 for providing electrical contact without producing a commensurate increase in the force required to engage the pin within the contact region 25.

Each of the contact vanes 40 is enclosed within the integral protective outer can portion 23 to provide protection of the contact vanes 40 when shaped to form radially inwardly directed contact points 42 thereon.

Each vane 40 is formed with the radially inwardly directed contact edge 42 formed between beam segments 50, 52 that will become fully supported along their length following inserting of a contact pin. Inner contact surfaces 50*a,* 52*a* on beam segments 50, 52 are displaced radially outwardly when a pin is inserted in socket 44 so as to be supported by the inner circumferential surface 23*b* of the protective can portion 23. One of such supported vanes 40 is shown in broken outline in FIG. 4 at reference numeral 67.

Such an arrangement defines a secondary current path through the terminal from the contact portion 25 to the attachment portion 26 thereof. More particularly, since each of the contact vanes is a beam 40 that is subjected to torsional and bending stresses, pin insertion will cause each of the vane type beams 40 to twist and straighten so as to come into contact with the integral can 23 at a significant normal force there between thereby to provide a current path from the pin through the can and its connecting strap as well as through pin contact with the contact segments 42.

Another aspect of the invention is that the contact vanes 40 can be stamped from a high mass conductive material having a thickness of for dissipating heat generated within high current flow connector systems having such current capacities. In respective configurations current levels can be 30 to 200 amps; material thickness is 0.40 mm to 0.80 mm and material examples include BeCu (ASTM B534), tin brass (B591).

What is claimed is:

1. An electrical female terminal comprising an attachment portion; a contact portion and a protective can portion and wherein each of said attachment portion, contact portion and protective can portion are integrally connected characterized by: said contact portion having circular end strips and a plurality of circumferentially spaced contact vanes formed as beams having opposite ends connected to the circular end strips at longitudinally aligned locations, and each vane being twisted on its length in a radially inward direction to provide a radially inwardly directed contact edge for providing a torsional force component that increases normal forces for providing electrical contact without producing a commensurate increase in the force required to engage a pin within the contact portion; and the plurality of vanes each being wave shaped and longitudinally asymmetrical having longitudinally offset centers in a circumferential direction, the plurality of vanes each having an end to end length and a base width, wherein the amount of torsional force in each of said plurality of contact vanes is determined by the amount of offset formed between the centers of each one of the plurality of contact vanes, the length of each one of the plurality of contact vanes and the width of the base of each one of the plurality of contact vanes.

2. The electrical female terminal of claim 1 wherein said protective can portion is an integral outer can;

each of said contact vanes are enclosed within said outer can to protect said contact vanes.

3. An electrical female terminal of claim 1 wherein each of said plurality of circumferentially spaced contact vanes has a radially inwardly directed contact portion thereon and said protective can portion fully supports each of said contact vanes between the opposite ends thereof during mating with a pin inserted within said contact region.

4. The electrical female terminal of claim 1 wherein said contact vanes are formed from a high mass material for dissipating heat generated within high current flow connector systems.

5. An electrical female terminal comprising an attachment portion; a contact portion and a protective can portion and wherein each of said attachment portion, contact portion and protective can portion are integrally connected characterized by: said contact portion having circular end strips and a plurality of circumferentially spaced contact vanes formed as beams having opposite ends connected to the circular end strips at longitudinally aligned locations, each vane being wave shaped along a radial plane and twisted on its length to provide a radially inwardly directed contact edge for providing a torsional force component that increases normal forces for providing electrical contact without producing a commensurate increase in the force required to engage a pin within the contact portion, and each of the contact vanes being responsive to contact with an inserted pin to be subjected to torsional and bending stresses that will cause each of the vanes to twist and straighten so as to come into contact with the protective can portion at a significant normal force there between thereby to provide a current path from the pin through the protective can portion and its connecting strap as well as through contact with said contact portion.

6. An electrical female terminal comprising an attachment portion; a contact portion and a protective can portion and wherein each of said attachment portion, contact portion and protective can portion are integrally connected characterized by: said contact portion having terminal body portions; said contact portion including a plurality of circumferentially spaced contact vanes formed as beams having opposite ends connected to said terminal body portions and wherein each vane is twisted on its length to provide a radially inwardly directed contact edge for providing a torsional force component that increases normal forces for providing electrical contact without producing a commensurate increase in the force required to engage a pin within the contact portion, said terminal body portions being annular strips, each of said annular strips having opposite ends with a gap formed therebetween, a connector strap having opposite ends, one of said opposite ends integrally connected to said protective can portion and the other of said opposite ends integrally connected to one of said annular straps diametrically opposite said gap therein; and wherein each of said plurality of circumferentially spaced contact vanes has a radially inwardly directed contact edge of the contact portion thereon and said protective can portion fully support and engage continuously each of said contact vanes between the opposite ends thereof during mating with a pin inserted within said contact region.

7. The electrical female terminal of claim 6 wherein said vanes having offset centers and end to end length and a base width;

said amount of torsional force in each of said contact vanes determined by the amount of offset formed between the centers of each vane, the length of each vane and the width of the base of each of the vanes.

8. The electrical female terminal of claim 6 wherein said protective portion is an integral outer can;

each of said contact vanes are enclosed within said outer can to protect said contact vanes.

9. The electrical female terminal of claim 6 wherein each of said contact vanes is responsive to contact with an inserted pin to be subjected to torsional and bending stresses that will cause each of said vanes to twist and straighten so as to come into contact with said protective portion at a significant normal force there between thereby to provide a current path from the pin through the can and its connecting strap as well as through contact with said contact region.

10. The electrical female terminal of claim 6 wherein said contact vanes are formed from a high mass material for dissipating heat generated within high current flow connector systems.

11. A one-piece electrical female terminal comprising:

an attachment portion, a contact portion and a protective outer can portion that are integrally connected, a connector strap having opposite ends, one of the opposite ends integrally connected to the protective outer can portion and the other of the opposite ends connected to contact portion, the contact portion being disposed in the protective outer can portion and having circular end strips and a plurality of circumferentially spaced contact vanes formed as beams having opposite ends connected to the circular end strips at longitudinally aligned locations, each contact vane being wave shaped with an offset center portion and twisted on its length to provide a radially inwardly directed contact edge for providing a torsional force component for providing electrical contact when a pin is inserted into the contact portion, each of the contact vanes being responsive to contact with the pin to be subjected to torsional and bending stresses that will cause each of the contact vanes to twist and straighten so as to come into contact with the protective outer can portion at a significant normal force there between thereby to provide a current path from the pin through the protective can portion and the connector strap as well as through contact with the contact portion.

* * * * *